US008615833B2

(12) United States Patent
Cavalli et al.

(10) Patent No.: US 8,615,833 B2
(45) Date of Patent: Dec. 31, 2013

(54) METHOD AND WASHING MACHINE PROVIDED WITH RECIRCULATION WITH CONTROLLED FLOW

(75) Inventors: Cirilo Alex Cavalli, Curitiba Paraná (BR); Johninson Imhoff, Curitiba Paraná (BR); Marcelo Piekarski, Curitiba Paraná (BR)

(73) Assignee: Electrolux Do Brazil S.A., Curitiba (BR)

( * ) Notice: Subject to any disclaimer, the term of this patent is extended or adjusted under 35 U.S.C. 154(b) by 280 days.

(21) Appl. No.: 12/968,096

(22) Filed: Dec. 14, 2010

(65) Prior Publication Data

US 2011/0138543 A1 Jun. 16, 2011

(30) Foreign Application Priority Data

Dec. 14, 2009 (BR) ..... 0905459

(51) Int. Cl.
*D06F 33/00* (2006.01)

(52) U.S. Cl.
USPC ..... 8/158; 68/12.21

(58) Field of Classification Search
USPC ..... 68/12.19, 12.21, 23.5; 8/158, 159
See application file for complete search history.

(56) References Cited

U.S. PATENT DOCUMENTS

| | | | | |
|---|---|---|---|---|
| 7,703,306 | B2 | 4/2010 | Shaffer | |
| 2006/0000030 | A1 * | 1/2006 | Shaffer | 8/159 |

FOREIGN PATENT DOCUMENTS

| | | |
|---|---|---|
| CA | 1112889 | 11/1981 |
| EP | 0278461 Al | 8/1988 |
| EP | 1783264 A2 | 9/2007 |
| EP | 2267211 A1 | 12/2010 |
| ES | 8604326 | 12/1983 |

* cited by examiner

*Primary Examiner* — David Cormier
(74) *Attorney, Agent, or Firm* — Banner & Witcoff, Ltd.

(57) ABSTRACT

A washing machine provided with recirculation with controlled flow. It further presents a method to control the level of the washing liquid, associated to the said machine, providing economy of resources such as water and cleaning products, guaranteeing an effective washing of clothes and similar articles, still associated with a decreases foam formation and lower nose emissions during the process, thus improving the operation of the equipment. The washing machine is provided with a washing tub (2), a basket (3), a two-way pump (7), level sensor (5), pool (6), recirculation hose (9), drainage hose (8) and control circuit.

9 Claims, 14 Drawing Sheets

METHOD AND WASHING MACHINE PROVIDED WITH RECIRCULATION WITH CONTROLLED FLOW

FIELD OF THE INVENTION

This invention belongs to the mechanical engineering field, more specifically of the electromechanical devices, commonly known as home appliances, especially applied to washing machines and the like, exactly a washing method and recirculation control associated to a washing machine provided with washing water recirculation with controlled flow.

BACKGROUND OF THE INVENTION

The washing machine is a very popular home appliance used to automatically clean clothes. It uses water as its main element. It basically consists of a reservoir which is filled with water, on which the mechanical system shakes the pieces of clothing to be washed. The contemporary machines are manufactured as two basic models, front loading or top loading. The top loading machines receive the clothes in a vertically mounted cylinder, with a central agitator and a top cover. The front loading machines have a horizontally mounted cylinder, with no central agitators, but with a watertight door and with a sight glass.

Both models have the capacity to automatically wash, propelled by an electric motor, conducting washing, rinsing and centrifugation runs. Currently, the use of electronic components replaces complex mechanical systems previously used to control the washing. They control, for example, the water level, one of the main functionalities of washing machines in the current art.

The control by means of electromechanical pressostates, which are devices used to perceive pressures or pressure differences and which, in the case of washing machines, can be translated by differences in the liquids level, is conducted by reading the level indicated by the pressure generated by a water column, which forces a diaphragm, thus activating an electric contact in a single determined point, with the disadvantage of not being able to identify the manometric height and present a continuous reading.

In its turn, the electronic pressostate forwards point-to-point information on the water column height by means of a transducer which varies the output voltage or current according to the pressure applied in the input, allowing a more precise control, admitting, in the most modern machines, the water input control.

The water level control in washing machines is also widely diffused, defining the water volume to be used in washing, upon the user's choice or a previously defined configuration for the equipment, based on a sensor, which is commonly the pressostate, which receives the pressure exerted by the water volume.

Another important event, besides the level control, among the other functionalities introduced in washing machines is recirculation.

Water recirculation is a common feature in washing machines, which is generally intended to homogenize cleaning agents and water, besides increasing the washing efficiency and collecting lints which are released from the clothes and which may affect the equipment performance. In addition, it can minimize the amount of water used for washing through water circulation optimization inside the equipment in certain steps of the washing run.

In order to improve water recirculation during the washing process, perforated baskets were developed, for which the number and size of the holes are dimensioned in order to decrease the total drainage area, thus decreasing the liquid flow from the basket to the tub, causing a delay in the process of balancing the manometric heights upon water recirculation, allowing the accumulation of a decreased amount of liquid in the tub, enabling a lower total water volume to be used in the washing process.

Despite of the recirculation advent, problems related to this functionality can be found as, for example, the excess of foam and high noise level. These problems are generated by air-water mixture, caused by the lack of water input flow control in the basket compared with the output flow from the basket to the tub, in addition to causing a non-uniform flow of the input of liquids into the basket. Without control, water drainage is not uniform when air and water are mixed in the bottom of the tank. This flow range can be significantly decrease when a controllable pump is used.

Currently, due to the mixture of air and water which occurs when the washing machine tub is empty, the use of common detergent generates a lot of foam, thus preventing a complete washing with this type of product from occurring.

Canadian Patent 1112889, according to FIG. 10, describes a washing machine which recirculates water or rinsing water. Its recirculation water input is intended to fully empty the tub, thus generating foam and noise during its operation. The remaining liquid is located in a recess of the tub, forming a pool, in order to prevent the pressostate from indicating that the tub is empty.

Document WO053042, according to FIG. 8, shows a washing machine provided with water recirculation, with the objective to empty the tub during recirculation, however, due to the lack of pump control, it does not maintain a minimum liquid level, producing foam and noise.

Document EP1783264, according to FIG. 9, reports a washing machine equipped with recirculation and a variable speed pump, however, the water level between the tub and the basket remains the same and does not save water Invention ES8604326 in the public domain, describes the recirculation process, very common in a washing machine, with recirculation controlled by two pressostates and level control elements calibrated for higher and lower level.

Document EP0278461 in public domain, describes the discharge and recirculation flow control process of washing machines based on two pressure sensors adapted to determine the minimum and maximum liquid levels present in the referred machine.

SUMMARY DESCRIPTION

This disclosure describes a washing machine provided with recirculation with controlled flow. It further presents a washing liquid level control method, associated with the referred machine, providing economy of resources such as water and cleaning products, guaranteeing an effective washing of clothing and similar articles, associated with lower foam formation and generation of noise during the washing process, thus improving the operation of the equipment, besides having the other recirculation and level control functionalities comprised in the current state of the art. Thus, it is evident that all these characteristics make the product free from the inconveniences found in the current state of the art, as previously mentioned.

It has a pool, consisting an a small internal reservoir formed by a recess in the tub, which guarantees the maintenance of a minimum liquid level by a recirculation pump flow control, thus avoiding the formation of foam by the air-water mixture in the mentioned pump, and as a result, reducing the level of noise during the operation.

The present disclosure provides an objective to present a method and a washing machine with the function of recirculating liquids from the bottom of the tub to the upper part of the basket which contains the clothes to be washed, in order to use a lower amount of water and increase the efficiency of the washing process, associated with an innovative method to adjust the washing and rinsing liquid level in the washing tub during the washing of clothing and similar articles, also allowing to minimize the noise and generation of foam.

The controlled recirculation described herein is an evolution of the existing techniques. In this concept, instead of using a two-state pump (turned-off or nominal speed), the disclosure proposes a pump working method intended to vary its speed and, consequently, its flow.

An aspect of the disclosure is to present a control intended to improve the recirculation concept, besides magnifying its application.

The use of a controllable pump and of a level reader allows the development of a method which is able to close a control loop on which it is possible to adjust a flow so that the system contains a small amount of water in the bottom of the machine; however, an amount which is large enough to prevent the mixture of air with water from occurring in the pump. This decreases the amount of generated foam, allowing the user to use common detergent.

In addition, considering that the traditional drainage pumps produce a lot of noise being at nominal speed and with little water in the bottom of the tank, the use of the machine and the proposed method allows decreased noise through minimizing the water-air mixture.

BRIEF DESCRIPTION OF THE DRAWINGS

FIG. 1 reveals a schematic view of the tub filling step with the washing liquid, where it can be noted the position of the washing basket (3) in relation to the washing tub (2), as well as the recirculation (9) and drainage (8) hoses, the pool (6) and the pump (7).

FIG. 2 shows a schematic view of the beginning of the washing liquid recirculation process step, where it can be noted, then, the difference of water level between the basket (3) and the tub (2) caused by the difference of input and output flow of water of the basket (3), being the washing water collected in the pool (6) and impelled by the pump (7) through the recirculation hose (9).

FIG. 3 depicts a schematic view of the washing step, consisting in the agitation of the clothes in a wash environment, i.e., the basket (3) completed with water in recirculation regimen from the pumping of the liquid collected in the pool (6) through the recirculation hose (9) using the pump (7).

FIG. 4 shows a schematic view of the washing water drainage step, where the liquid contained in the basket (3) is drained, flowing through the tub (2), being collected in the pool (6) and pumped by the pump (7) through the drainage hose (8).

FIG. 5 shows a schematic view of the centrifugation step, where the washing liquid contained in the basket (3) is drained, flowing through the tub (2), being collected in the pool (6) and pumped by the pump (7) through the drainage hose (8).

FIG. 6 reveals a schematic view of the complete washing process termination step with the basket (3) and the tub (2) being emptied, with a small amount of water remaining in the pool (6).

DETAILED DESCRIPTION

This invention comprises a washing machine having a recirculation and a washing liquid level control method.

Figure 7:
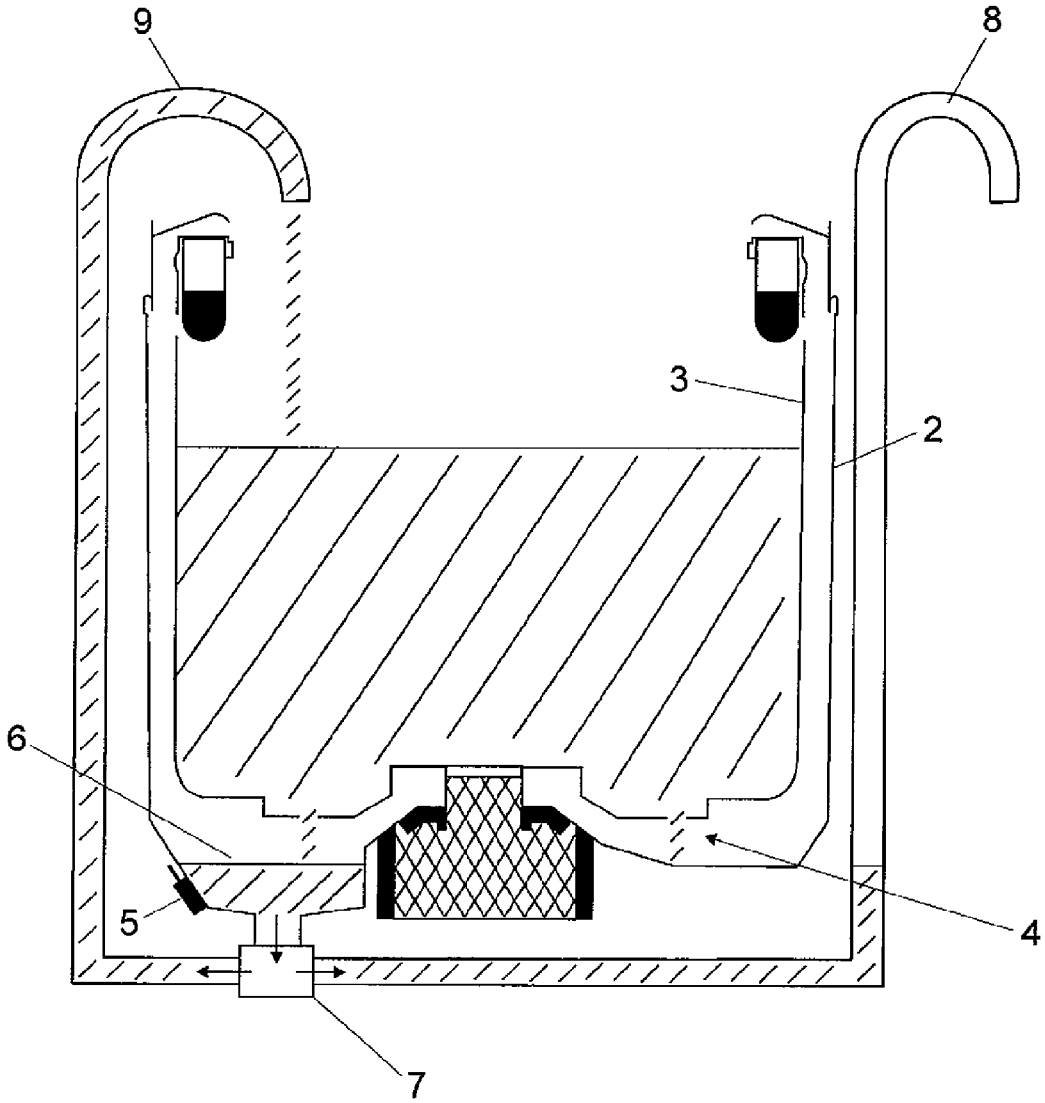
FIG. 7 shows a sectional view of the disposition of the proposed recirculation system, evidencing the level sensor (5) in the pool (6) and the basket (3) with a reduced number of holes (4) inserted in the tub (2), being the liquid recirculated from the pool (6) upon the impulse generated by the pump (7) through the recirculation hose (9).

The referred machine, according to FIG. 7, basically comprises a washing tub (2) equipped with a pool (6), perforated basket (3), two-way pump (7), level sensor (5), recirculation hose (9), drainage hose (8) and control circuit (not shown).

For the operation of the washing machine, the level sensor (5) reads the water column height in the tub (2), sends this information to the control circuit which processes the information and sends a signal to the two-way pump motor (7) so that it operates in the recirculation direction and ranges its speed, thus changing the water flow in order to maintain a minimum liquid level in the tub's (2) pool (6) in order to avoid cavitations in the pump (7) thus making the process less noisy and with decreased foam formation.

Figure 1:
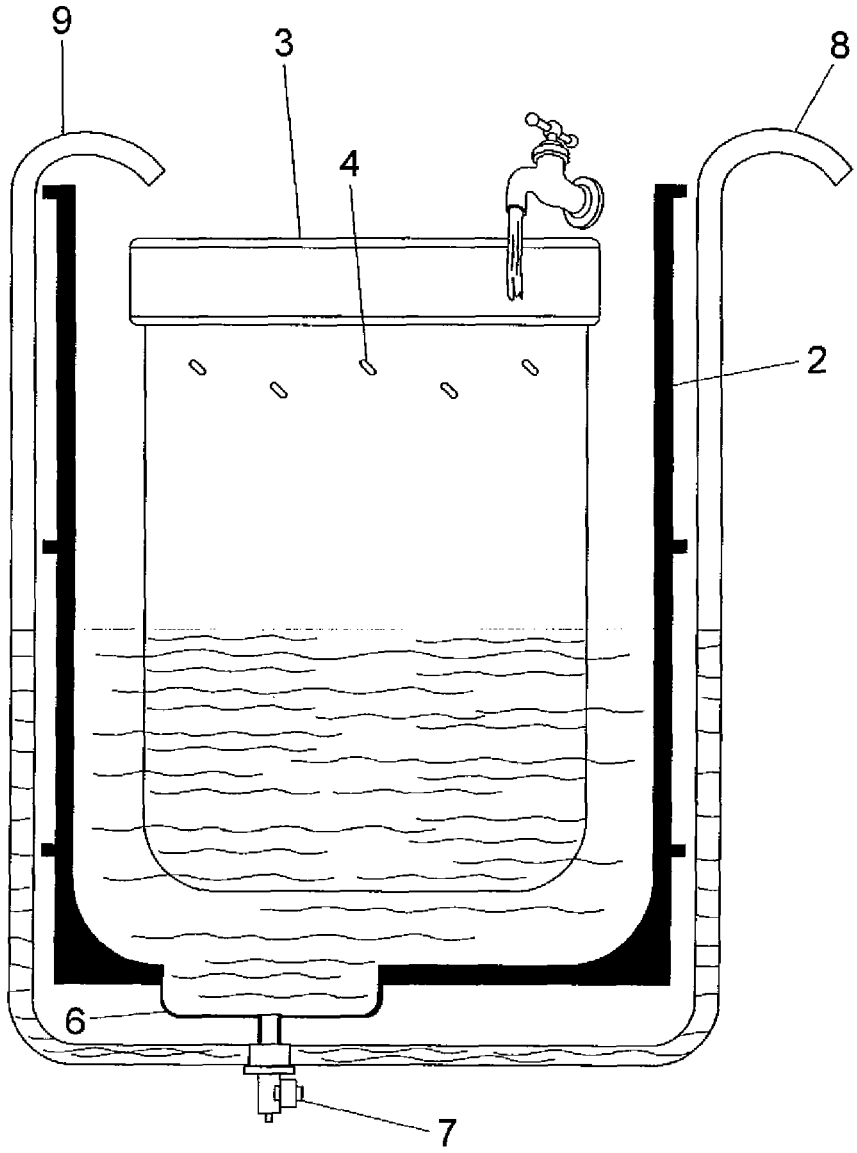
FIGS. 1 to 6 describe, schematically, sequentially, a washing process considering the proposed recirculation system.

To better understand the invention shown here, the analysis of the attached figures is required. FIG. 1 shows the initial process specifically proposed in the water filling step of the machine. After filling, according to a pre-programming of the control panel, it is noted that the manometric heights in the tub (2) and in the basket (3) are equal.

Figure 2:
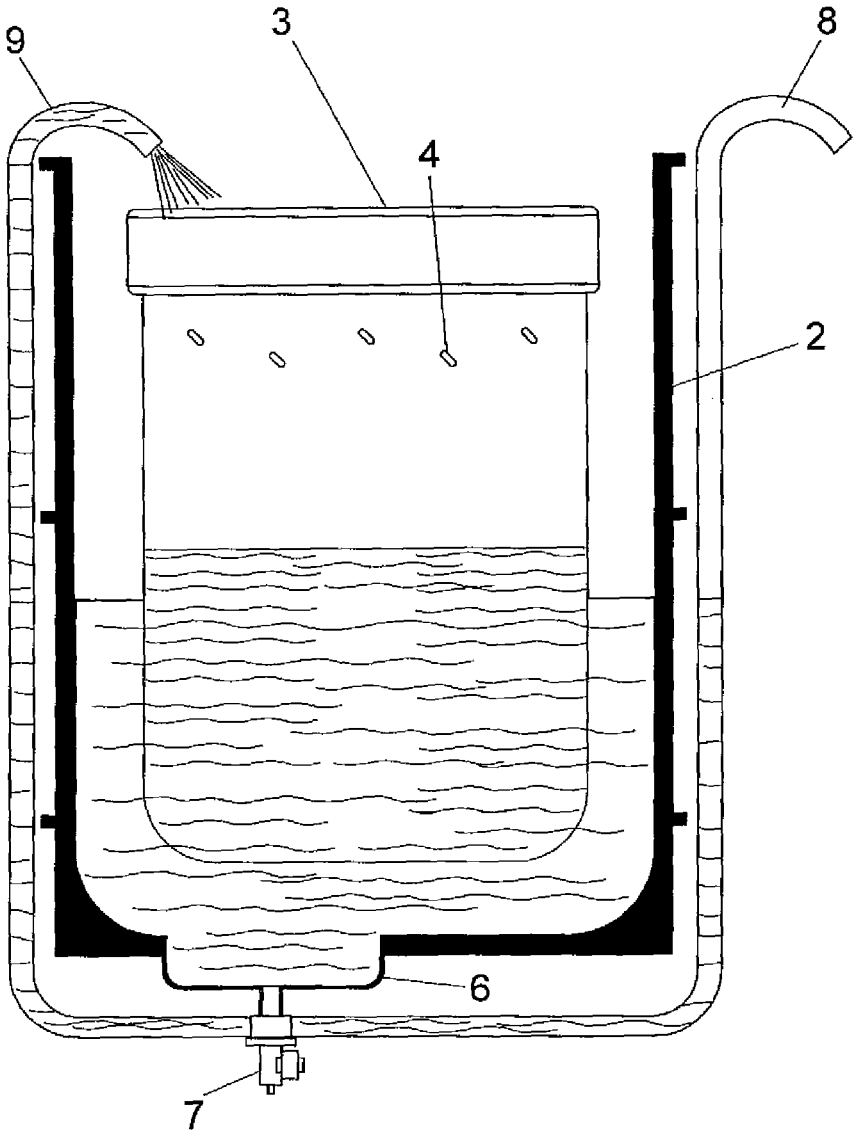

FIG. 2 shows the beginning of the washing and recirculation process, without the mechanical action of the agitator, in a preferred configuration. In this step, the manometric heights between the basket (3) and the tub (2) are different and the process consists in emptying the tub (2) and filling the basket (3) up to a programmed level (according to the program parameters), through the pump (7) in its water recirculation function. In this phase, the pump flow (7) is higher than the water flowing from the basket (3) to the tub (2).

During the entire process, the water level is monitored by the electronic circuit by means of signals originated by the level sensor (5).

Figure 3:
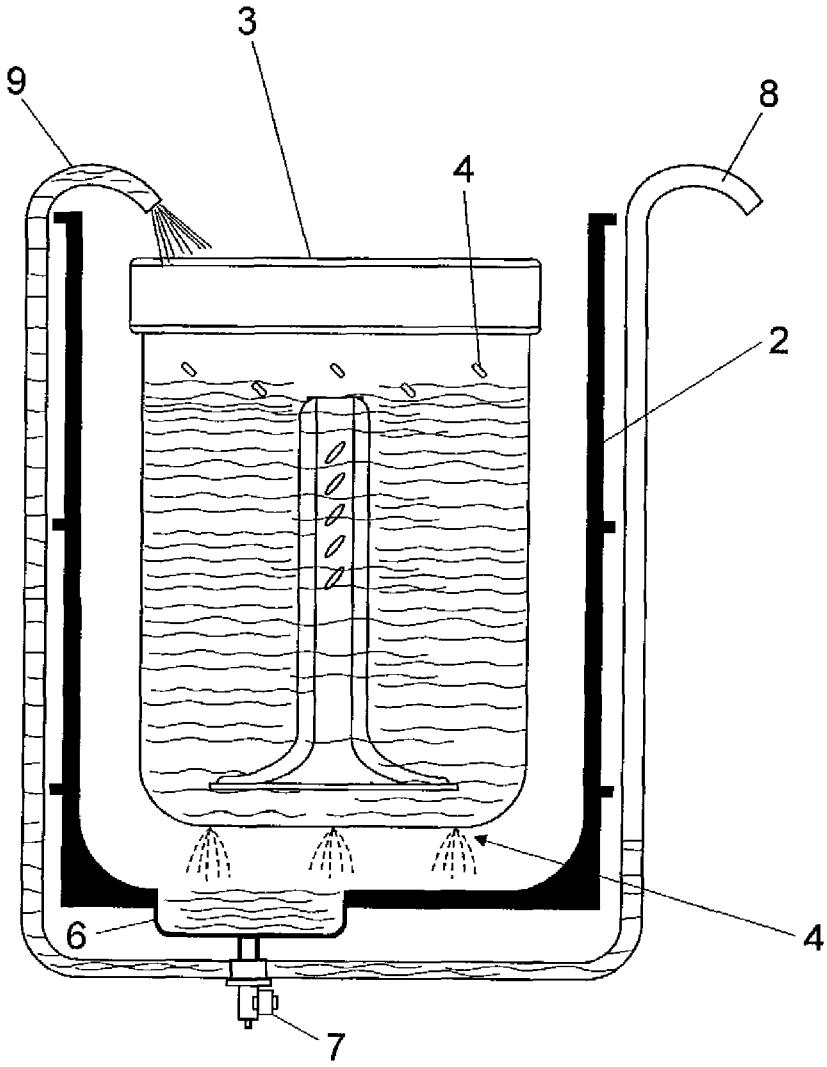

Once the programmed washing level is reached, the washing operation is started with the mechanical movement of the agitation elements (agitator, propeller or basket (3)). In this step, the objective is to maintain the highest liquid level inside the perforated basket (3) and the lowest level inside the tub (2), without allowing the pool (6) from being empty, as it can be noted in FIG. 3. It is noted that there is a liquid flow from the basket (3) to the tub (2) via lower holes located in the basket (3). By this time, the basket (3) flow is equal to the recirculation flow. Thus, the accumulation of a lower amount of liquid is allowed in the tub (2), enabling the washing machine to operate with a lower total volume of water for the washing process.

Figure 4:
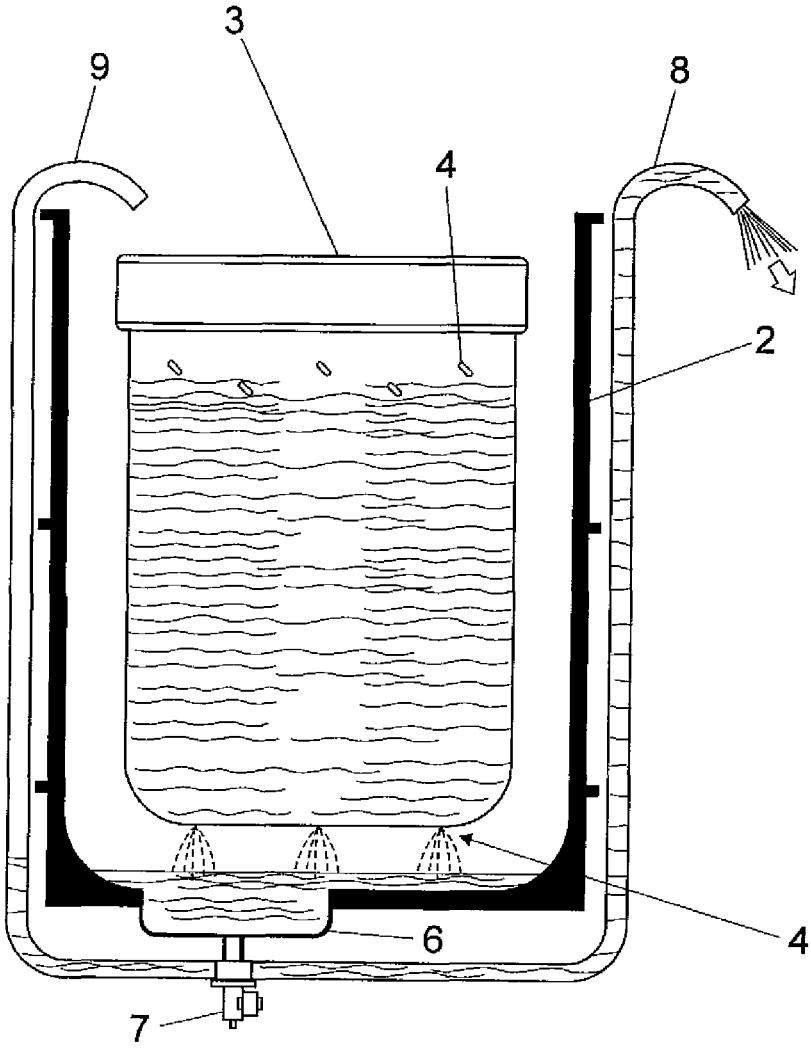

Following the washing step, the drainage step is started according to FIG. 4; in this phase the pump (7) changes the direction of rotation so as to pump water to the drainage hose (8) for discard. In an alternative mode, this process can be performed by a second pump, while a main pump is only used for recirculation. Another possibility is the use of a directing valve selectively fluidly coupling the single pump with the one input and two outputs.

Figure 5:
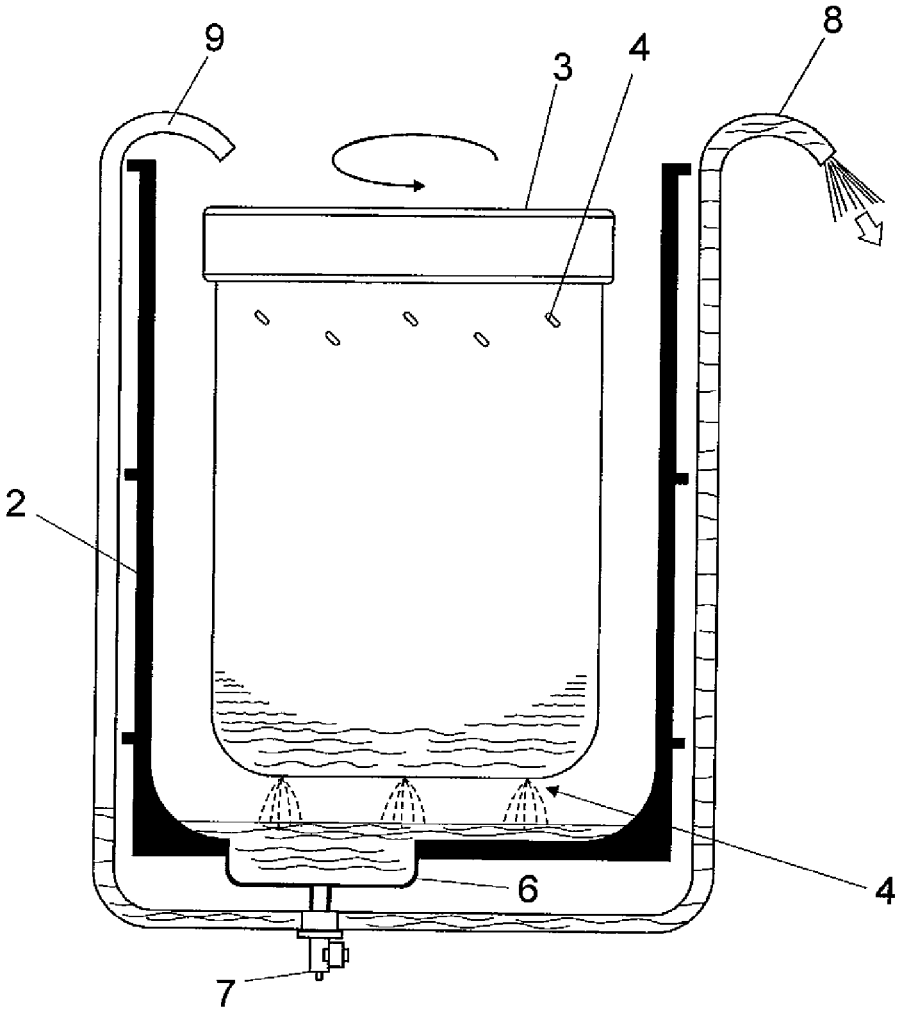
Figure 6:
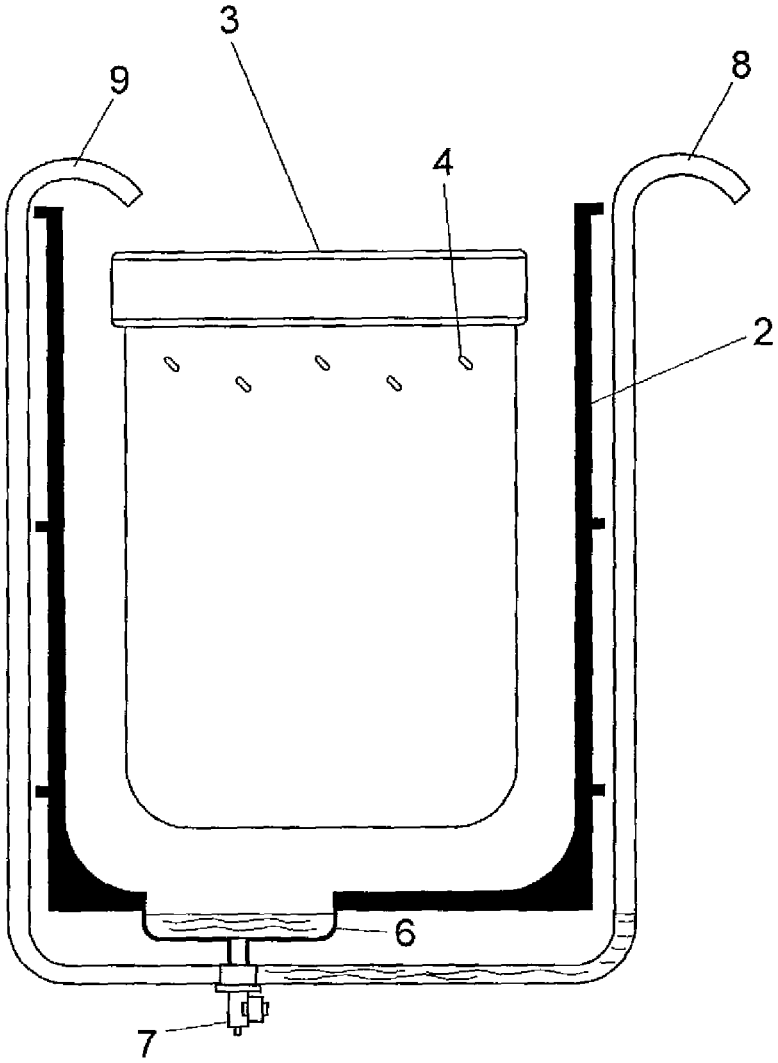

Following the drainage step (which does not necessarily imply the basket being completely empty), centrifugation is started, as shown in FIG. 5. In this step, it is noted the total emptying of the basket (3) by the action of the centrifugal force caused by the high speed rotation of the basket (3), being complemented by the pump (7) action to discard the excess of liquid. FIG. 6 shows the machine condition when the cycle is terminated.

Figure 7A:
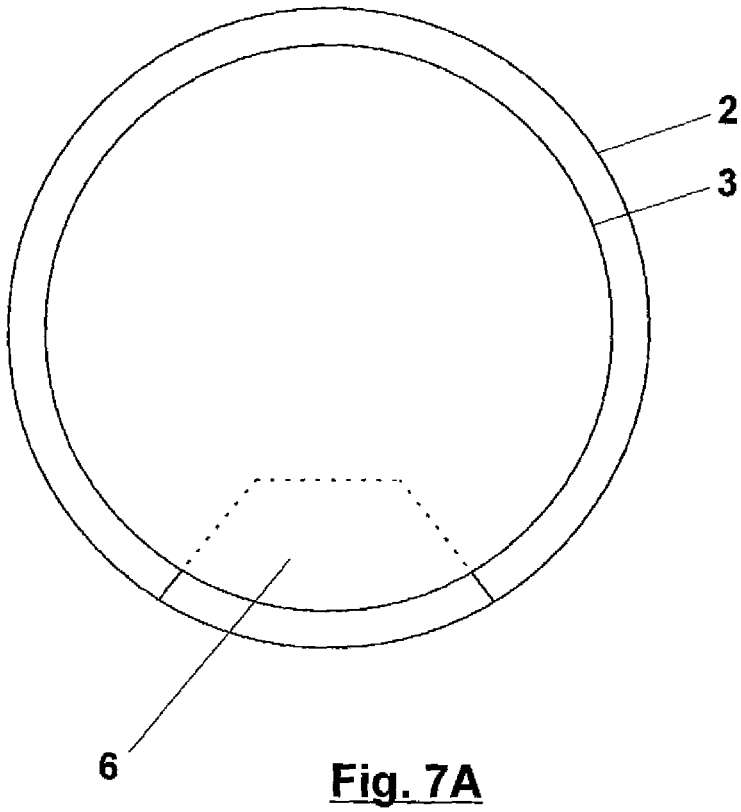
FIG. 7A shows an upper schematic view of the tub (2) highlighting the position of the pool (6) in relation to the referred tub (2).
Figure 8:
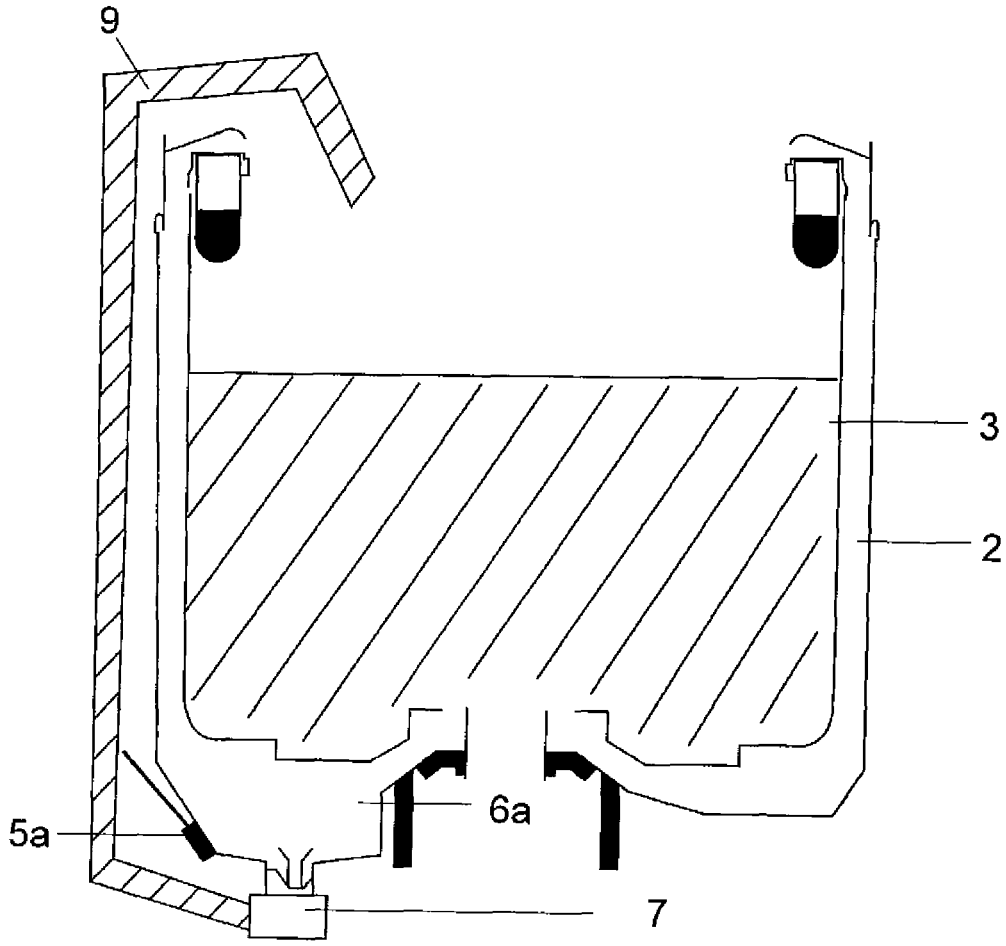
FIG. 8 shows a sectional view of another recirculation system described in the art, where it is noted the liquid being recirculated (8) directly from the tub (2) to the basket (3), further having a level sensor (5*a*), a pump (7) for recirculation and a reservoir (6*a*).
Figure 9:
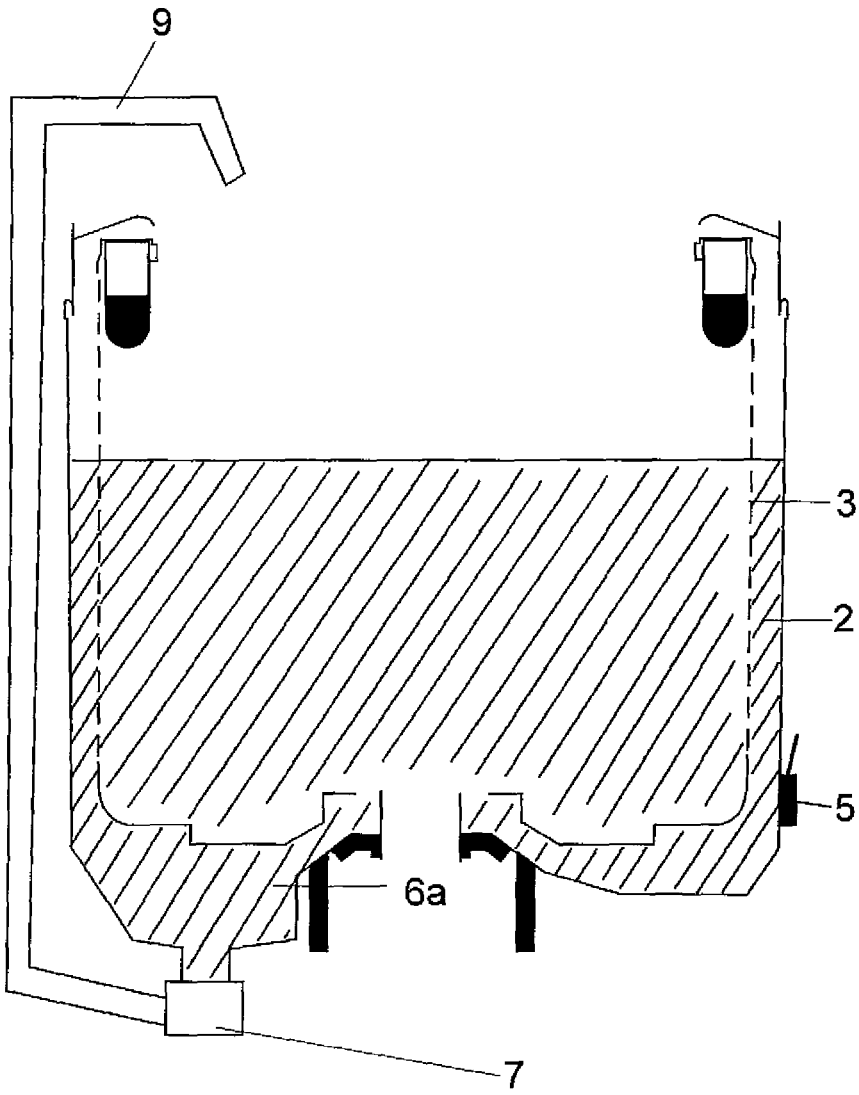
FIG. 9 reveals a sectional view of traditional recirculation systems described in the art, on which the basket (3) perforated throughout it side surface and the pressostate (5) present in the tub (2), with the pump (7) collecting the liquid in a reservoir (6*a*).
Figure 10:
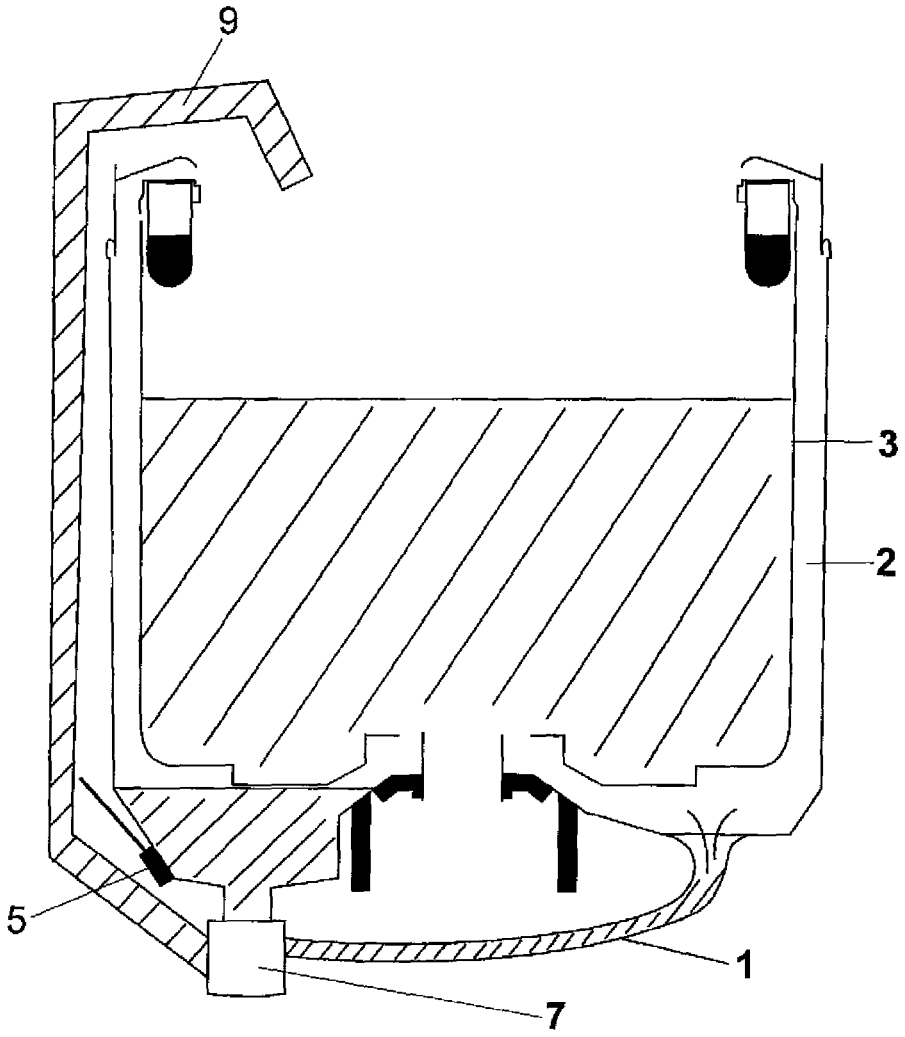
FIG. 10 depicts a sectional view of an alternative recirculation system described in the art, where it is noted the liquid being recirculated from the tub (2) to the basket (3) by means of a pump (7) through a duct (1) without maintaining a minimum level.
Figure 12:
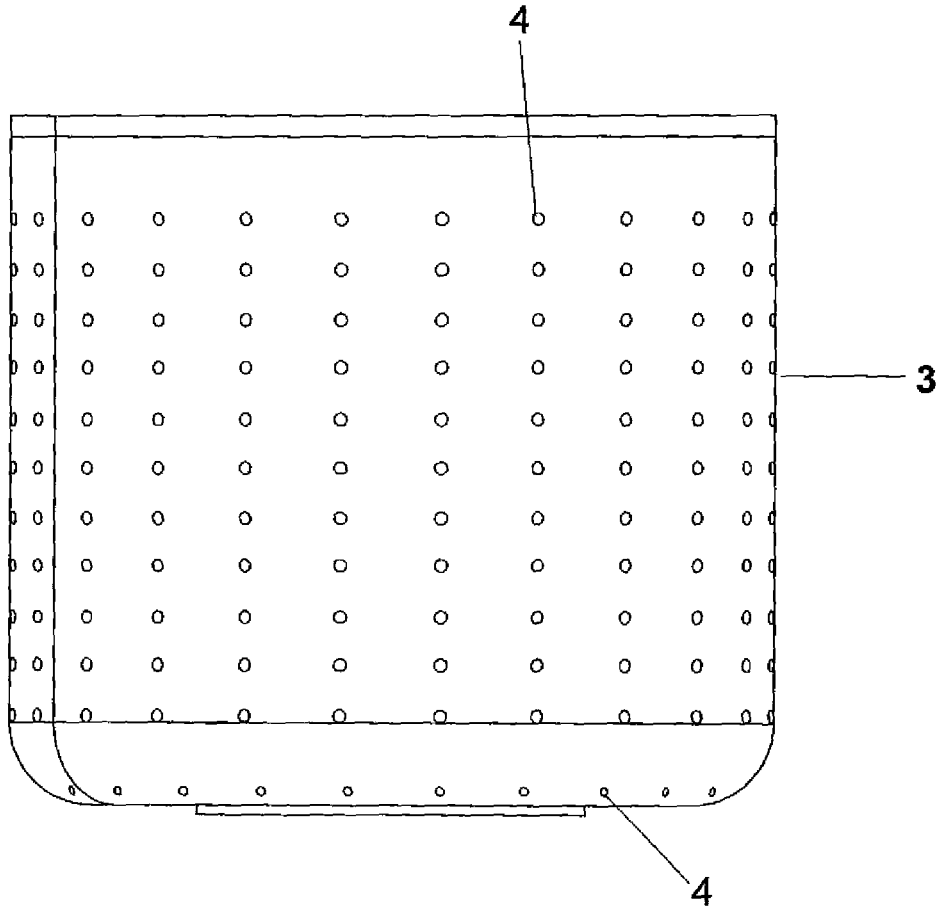
FIG. 12 shows a side perspective view of a basket (3) perforated throughout its entire side surface, commonly used in the current art.
Figure 13:
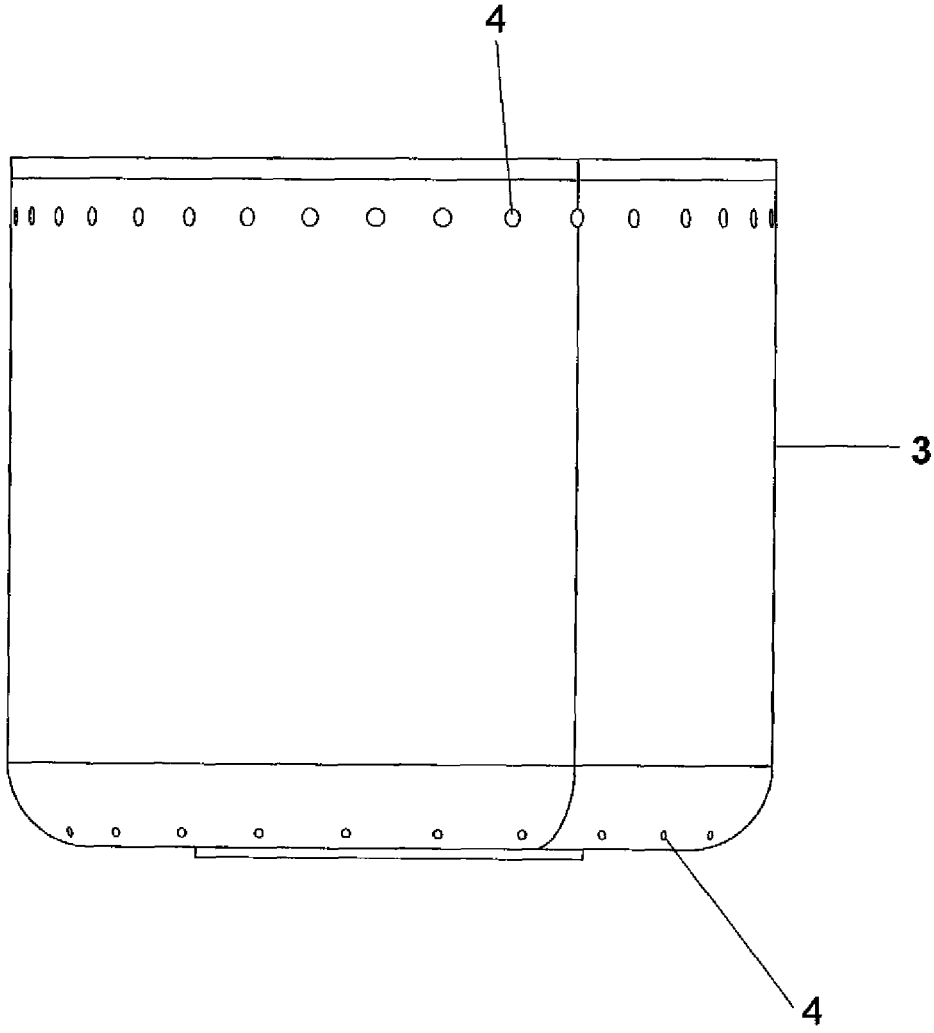
FIG. 13 reveals a side perspective view of the perforated basket (3) of the proposed solution, evidencing the decrease in number and size of the holes (4).

FIG. 7 schematically illustrates a preferred mode of the washing machine provided with recirculation with controlled flow. It is noted in the lower portion of the tub (2) a pool (6) which is responsible for guaranteeing a minimum liquid level for the correct operation of the proposed method. The pool (6) (i.e., a sub-reservoir) is formed by a recess in a small bottom portion of the tub (2), and is better viewed in detail in FIG. 7A. The machine further has a level sensor (5) which reads the water level contained in the pool (6) and sends the information to the electronic circuit (not shown) which commands the machine functions. The solution further includes a pump (7) with an input and two outputs, responsible for draining and recirculating the washing liquid. The proposed machine still includes a basket (3), a recirculation hose (9) and a drainage hose (8). The basket (3), shown in FIG. 13, contains a smaller amount of holes (4) in order to present a lower flow compared with a traditional basket, as shown in FIG. 12.

Figure 11:
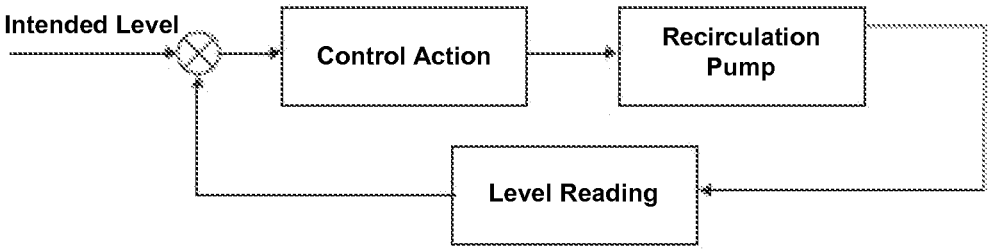
FIG. 11 shows a block diagram of the washing water level control logic.

The proposed method uses a closed loop system as described in FIG. 11, which continuously monitors of the liquid level in the tub (2). The control system acts on the pump (7) according to the liquid level reading in the tub (2). The action is performed as the pump (7) rotor speed changes.

Despite of the internal oscillations occurring during washing (agitation, for example), the method is sufficiently precise to work in order to absorb such variations.

The present invention further minimizes the water flow variations from the recirculation hose (9) to the basket (3) input due to the slight attenuation of the control method, once it allows a more uniform flow of liquid.

This invention is not limited to the representations commented or illustrated here, and should be understood in its wide scope. A number of changes and other representations of the invention will come to mind of those skilled in the art, with the benefit of the teaching presented in the previous descriptions and attached drawings. In addition, it should be understood that the invention is not limited to the specific disclosed form, and that change and other forms are understood as included within the scope of the attached claims. Although specific terms are used herein, they are used only as a generic and descriptive form and should not be construed as limiting.

The invention claimed is:

1. A washing and water recirculation method for a washing machine comprising:

supplying liquid to a tub until it reaches a predefined level;

continuously recirculating the liquid inside the tub with higher outflow out of the tub than a liquid drain basket's outflow to the tub;

monitoring a liquid level in a pool of the tub, wherein the pool is formed as a recess in the bottom of the tub;

recirculating the liquid with a constant outflow out of the tub until the liquid level in the pool reaches a minimum liquid level and a liquid level of the liquid drain basket reaches a maximum liquid level;

in response to determining the liquid level in the pool is at a minimum liquid level, controlling a speed of a pump for recirculating the liquid to continuously recirculate liquid in the tub so that the outflow out of the tub is equal to the liquid drain basket's outflow to the tub;

moving agitator elements to effect a washing operation;

draining the liquid from the tub; and spinning the liquid drain basket to effect centrifugation.

2. The washing and water recirculation method of claim 1 further comprising using a closed loop control system.

3. The washing and water recirculation method of claim 1 further comprising performing a continuous controlling of the liquid level in the pool by reading values measured by a level sensor and analyzing the values.

4. The washing and water recirculation method of claim 3 wherein the controlling of the speed of the pump is performed according to the analysis of values measured by the level sensor.

5. The washing and water recirculation method according to claim 1, wherein the pump is a variable speed pump and the method further comprises: operating the variable speed pump by commands from an electronic control system.

6. The washing and water recirculation method according to claim 1, further comprising continuously monitoring the liquid level in the pool by a level sensor.

7. The washing and water recirculation method according to claim 1, wherein at least a part of the method is performed by a liquid level control system inside the tub.

8. The washing and water recirculation method according to claim 1, wherein the controlling of the speed of the pump for recirculating the liquid to continuously recirculate liquid in the tub is performed during a washing stage.

9. The washing and water recirculation method according to claim 1, further comprising controlling the washing machine to have a uniform recirculation outflow.

* * * * *